US006402890B1

(12) United States Patent
Gustavsson et al.

(10) Patent No.: US 6,402,890 B1
(45) Date of Patent: Jun. 11, 2002

(54) METHOD AND DEVICE FOR OIL EVACUATION FROM A SHOE PRESS UNIT

(75) Inventors: Lars Gustavsson; Mattias Alsing, both of Karlstad; Sven-Ove Andersson, Hammarö, all of (SE)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 09/733,202

(22) Filed: Dec. 8, 2000

Related U.S. Application Data

(60) Provisional application No. 60/212,467, filed on Jun. 16, 2000.

(51) Int. Cl.[7] ..... D21F 3/08

(52) U.S. Cl. ..... 162/199; 162/358.3; 162/361; 100/153

(58) Field of Search ..... 162/199, 272, 162/358.3, 358.5, 361; 100/153; 492/20

(56) References Cited

U.S. PATENT DOCUMENTS 4,917,768 A * 4/1990 Ilmarinen ..... 162/358.3
5,302,252 A * 4/1994 Gotz ..... 162/358.5
5,645,691 A * 7/1997 Zuefle et al. ..... 162/358.3
5,935,385 A 8/1999 Grabscheid et al.
6,030,502 A * 2/2000 Meschenmoser ..... 162/358.3

* cited by examiner

*Primary Examiner*—Karen M. Hastings
(74) *Attorney, Agent, or Firm*—Alston & Bird LLP

(57) ABSTRACT

A shoe press unit comprises a support beam, a shoe element movably supported on the beam, a pressing unit arranged between the beam and the shoe element for urging the shoe element away from the beam and toward a counter element, and a flexible belt that is arranged to slide over the pressing surface of the shoe element. An oil evacuation arrangement is affixed to the shoe element proximate an upstream edge region thereof. The oil evacuation arrangement has an inlet opening located such that excess oil expelled from between the belt and the shoe element passes through the inlet opening. An evacuation duct is connected with the container for evacuating oil therefrom, and the duct is movably connected to an outlet pipe within the shoe press unit. In one embodiment, the duct is connected via a flexible bellows to a pipe fixed to the outlet pipe.

18 Claims, 3 Drawing Sheets

METHOD AND DEVICE FOR OIL EVACUATION FROM A SHOE PRESS UNIT

CROSS-REFERENCE TO RELATED APPLICATION

The present application claims the benefit of the filing date of U.S. Provisional patent application 60/212,467, filed Jun. 16, 2000.

FIELD OF THE INVENTION

The present invention relates to shoe press units used, for example, in papermaking for pressing a paper web. The invention relates more particularly to a method and a shoe press unit in which excess lubricating oil that is expelled from between a pressing surface of a press shoe and a flexible belt is captured and evacuated from the shoe press unit.

BACKGROUND OF THE INVENTION

A shoe press unit typically comprises a support beam, a shoe element movably supported on the beam, a pressing unit arranged between the beam and the shoe element for urging the shoe element away from the beam and toward a counter element such as a counter roll, and a flexible belt that is arranged to slide over the pressing surface of the shoe element. To reduce friction between the belt and the shoe element and thereby reduce the frictional heating of the belt, it is common to supply a lubricating oil between the pressing surface of the shoe element and the belt. The oil both lubricates and cools the belt and the pressing surface. Excess oil is expelled from between the belt and the pressing surface as a result of the pressure exerted in the nip between the shoe element and the counter element. The excess oil is expelled from an upstream edge region of the pressing surface, and is then evacuated from the shoe press unit by an oil evacuation arrangement.

U.S. Pat. No. 5,935,385 discloses a shoe press unit having an oil evacuation arrangement in which an inlet opening of the oil evacuation arrangement is arranged on the beam at a distance from the shoe element. Therefore, the oil evacuation arrangement does not move with the shoe element. The inlet opening is so located that most or all of the initial kinetic energy of the excess oil exiting from between the belt and pressing surface is lost before the excess oil passes through the inlet opening. Thus, this kinetic energy of the oil is not available to assist in evacuating the oil. Another disadvantage of the oil evacuation arrangement is that it does not prevent the excess oil from flowing in various directions within the shoe press unit, and hence the oil tends to accumulate in the shoe press unit. The accumulated oil tends to mix with air, which makes evacuation of the oil more difficult and also requires a subsequent processing of the evacuated oil to separate the air from the oil prior to reusing the oil. The accumulated oil, which is relatively hot because of the heat transfer from the belt to the oil, also tends to conduct heat to other parts of the shoe press unit before it is evacuated, which results in an undesirable temperature increase inside the shoe press unit. Moreover, it is disadvantageous to have an accumulation of oil in the shoe press unit because this requires an increased power consumption. Finally, constructing the oil evacuation arrangement as an integral part of the shoe element requires relatively costly manufacturing methods.

SUMMARY OF THE INVENTION

The present invention addresses the above and other needs by providing a method and a shoe press unit in which an oil evacuation arrangement is affixed to the shoe element proximate an upstream edge region of its pressing surface, such that the shoe element and oil evacuation arrangement move together as a unit. The oil evacuation arrangement includes an evacuation duct for evacuating the excess oil expelled from between the belt and the shoe element. The evacuation duct is coupled to an outlet pipe for the evacuated oil within the shoe press unit. The evacuation duct is fixed relative to the shoe element and the outlet pipe is fixed relative to the beam, and the evacuation duct is movably connected to the outlet pipe such that the duct can move relative to the outlet pipe in at least the pressing direction along which the shoe element is moved by the pressing unit.

In accordance with a preferred embodiment of the invention, the oil evacuation arrangement comprises a container having a bottom and a plurality of wall elements upstanding from the bottom. The excess oil is squirted out from between the belt and pressing surface through an inlet opening of the container. The evacuation duct preferably includes a substantially rigid tubular member that is affixed in the container. In one embodiment, the tubular member extends through a through-hole formed in the beam and connects with the outlet pipe arranged in the interior of the beam.

The duct is coupled to the outlet pipe in one embodiment via a flexible sealing device that accommodates relative movement between the duct and outlet pipe in at least the pressing direction, and preferably also accommodates lateral movement of the duct that can arise for example from thermal expansion or lateral movement of the shoe element. In one embodiment, the sealing device comprises a bellows formed of an elastomeric material such as rubber. In another embodiment, the duct is coupled to the outlet pipe via a pair of tubular members one of which is slidably and sealingly received in the other. One of the tubular members can be fixedly connected to the container on the shoe element, and the other tubular member can be fixedly coupled with the outlet pipe. In yet another embodiment, the tubular member fixed to the container is slidably received in a sealing manner in an opening formed through a wall of the outlet pipe. The tubular member is sealed relative to the outlet pipe by one or more seals arranged at the opening in the outlet pipe.

The shoe press unit in a preferred embodiment comprises a closed shoe press unit, and the interior of the shoe press unit has an overpressure relative to the pressure outside the shoe press unit of 10-500 mbar. More preferably, the interior overpressure is below 200 mbar, and most preferably is below 50 mbar. The outlet pipe can be connected to a vacuum source outside the shoe press unit to facilitate the evacuation of oil.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
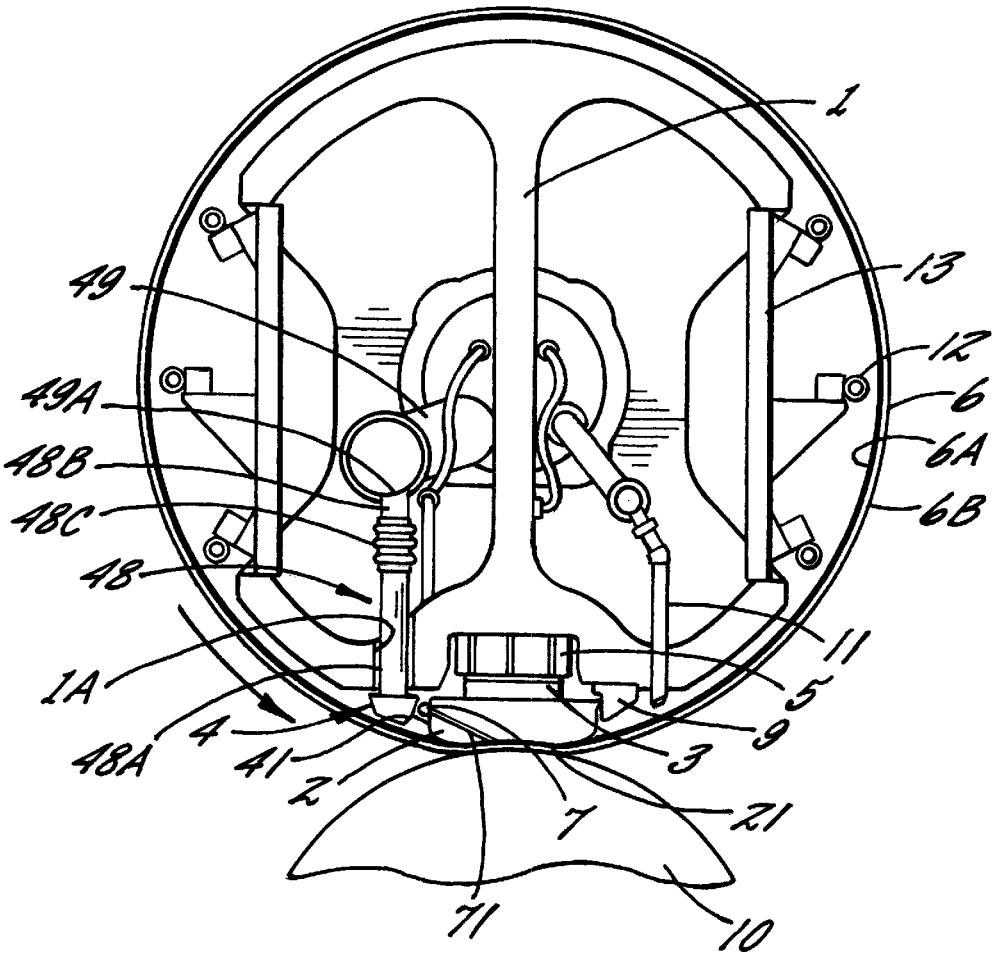
FIG. 1 is a cross-sectional view, viewed in a cross-machine direction, of a shoe press unit in accordance with one preferred embodiment of the invention.
Figure 2:
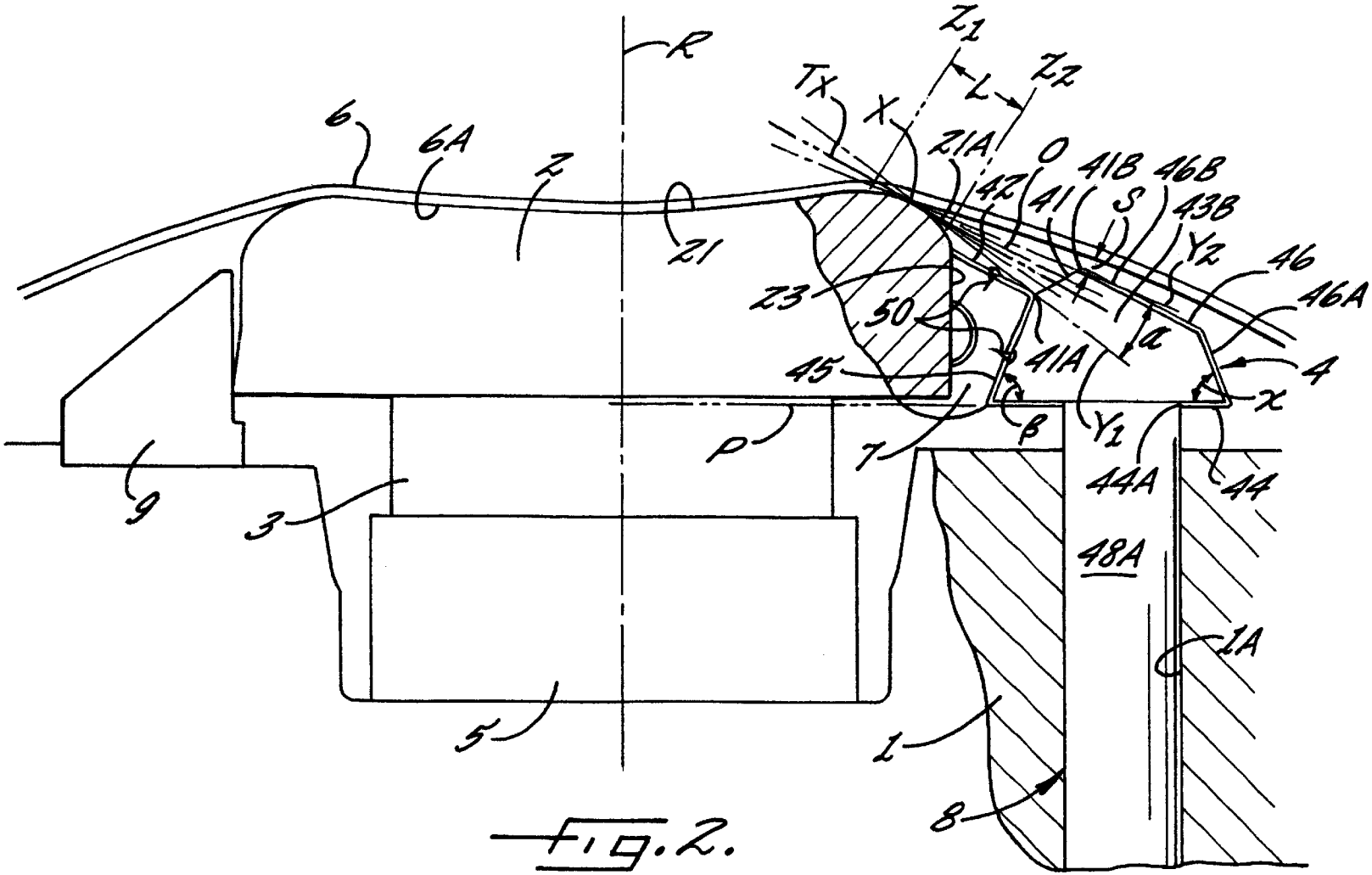
FIG. 2 is an elevation, viewed in the cross-machine direction and partly in cross-section, of the shoe press unit of FIG. 1.

FIG. 1 shows, partly in cross section, a shoe press unit according to one embodiment of the invention. The shoe press unit comprises a support beam 1, in which a recess is arranged for a pressing unit 3, 5 for a shoe element 2. The pressing unit 3, 5 preferably comprises a hydraulic piston 3, which is arranged in a sealing manner inside a hydraulic cylinder 5, so that the shoe element 2 can be moved hydraulically back and forth in a direction R, which is at right angles in relation to the extent of the shoe element 2 in the longitudinal direction. A support heel 9 is arranged at one short end of the shoe element 2. An endless, flexible belt/jacket 6 is arranged so as to interact, by means of its one surface 6A, with a pressing surface 21 of the shoe element 2 and, by means of its other surface 6B, with a counter-roll (not shown). The endless belt 6 moves from right to left in FIG. 1. The heel 9 is therefore arranged at the downstream end of the shoe element 2. The shoe unit 2 is, according to the illustrated embodiment, symmetrically formed in each edge region of the pressing surface 21. In the upstream end of the shoe element 2 there is a marked end region $Z_1$ –$Z_2$, which is a region with a convex curved surface 21A. As can be seen from the figure, the lengthwise extent L of the upstream edge region 21A is considerably shorter than the concave part 21 of the pressing surface. Within the upstream edge region 21A there is a transversely extending line X at which contact is first made between the belt 6 and the pressing surface 21 of the shoe unit.

At the upstream end of the shoe element is a distribution chamber 7 which in a known manner supplies the pressing surface 21 with oil via ducts (not shown). At said distribution chamber there is an oil evacuation arrangement 4 which comprises a guide plate or partition 42, a container part 45, 44, 46, 43A, 43B, an evacuation duct 8 and an inlet opening 41. The container part consists of a first longitudinal wall element 45, a plane bottom portion 44, a second longitudinal wall element 46 and two end walls 43A, 43B. The upstream longitudinal wall 46 is divided into a lower section 46A and an upper section 46B. The lower wall section 46A is arranged at an acute angle $\chi$ in relation to a plane P containing the plane bottom surface 44. According to the preferred embodiment, the angle $\chi$ is approximately 60–70°. The upper section 46B is arranged at a smaller acute angle in relation to the plane P. In this way, the upper section 46B preferably has an inclination that differs only by a few degrees from the tangent of the belt 6 in the region of the upper section 46B. The upper section therefore converges slightly towards the inner surface of the belt. The end 41B of the upper section forms an upper delimiting surface of the inlet opening 41, which is slot-shaped. It is advantageous that this upper delimiting surface 41B be positioned close to, or in certain cases even in contact with, the inner surface of the belt 6, so that as small a gap as possible is formed between them. The downstream wall element 45 is also arranged at an acute angle in relation to the plane P. According to the preferred embodiment, the downstream wall element 45 forms an angle $\beta$ which is essentially the same as the angle $\chi$ of the other wall element 46A. End walls 43A, 43B are arranged at either short end of the container. A lower delimiting surface 41A of the inlet opening 41 is formed by the upper edge of the downstream longitudinal wall element 45. All the components forming part of the container advantageously are made of thin sheet metal. In the preferred case, the sheet is 2 mm thick. Extending at right angles from the lower delimiting surface 41A in the direction of and up to the shoe element 2 is a guide plate or partition 42. The guide plate 42 is also made from thin sheet metal and it and the container are suitably made from one and the same piece of sheet metal which is suitably first stamped out and then bent into the desired final shape, after which the end walls 43A, 43B are connected in a sealing manner, suitably by means of welding, to the parts which have been bent up to form the container. Arranged in the bottom of the container is a circular hole 49, in which an evacuation pipe 8 is arranged in a sealing manner. Suitably, the evacuation pipe 8 is made of a sufficiently rigid material, e.g., metal, that it cannot be compressed by the outer overpressure normally existing inside the shoe press unit. The container portion is fixed by means of screw connections 48 to the distribution chamber 7 which is in turn connected (usually screwed) to one longitudinal side wall 23 of the shoe element. The evacuation arrangement 4 is therefore firmly anchored on the shoe element 2, so that these are movable as a unit.

For the purpose of enabling movement of the shoe element and the evacuation arrangement 4, the oil evacuation arrangement 4 comprises a first evacuation duct 48A, a rubber bellows 48C, an upper connection duct 48B and an outlet pipe 49. It is clear that the rubber bellows 48C can offer good flexibility in many directions, not only for vertical movement between the two ducts 48A, 48B but also with regard to angular deviations and also displacements in the transverse direction which may occur under certain operating conditions. The two ducts 48A, 48B are suitably made from a dimensionally stable material, for example metal, so that they cannot be compressed by outer overpressure. FIG. 1 also shows that the shoe press unit is provided with a secondary oil evacuation arrangement 11 which is suitably used as an oil evacuation system when at a standstill. The figure also shows that the shoe press unit is provided with belt guides 12 which are arranged on a support plate 13 and the purpose of which is to make possible installation/removal of the belt/jacket 6.

As already mentioned, the evacuation arrangement 4 is positioned with its upper delimiting surface 41B of the inlet opening 41 relatively close to the surface of the belt, so that the distance S between them during operation is sufficiently small to prevent any significant quantity of oil escaping between the opening 41 and the belt 6. The distance S preferably should not exceed 10 mm. The inlet opening 41 should moreover be positioned in such a manner that the quantity of excess oil which is pressed out can squirt directly into the inlet opening 41. According to the preferred embodiment, this is brought about by virtue of the fact that the tangent Tx of the convex curved surface at the contact line X between the belt 6 and the shoe element 2 extends between the lower delimiting surface 41A and the upper delimiting surface 41B. In this case, the geometries between the edge region 21A and the inlet opening should be arranged so that the tangent Tx (which can be considered to represent a kind of median vector for the oil excess which normally squirts out in a divergent manner) of the contact line X deviates by a maximum of 15° from at least one of the imaginary straight lines Y1 and Y2 that extend respectively between the contact line X and the lower delimiting surface 41A and between the contact line X and the upper delimiting surface 41B of the inlet opening 41. Furthermore, the inlet opening 41 should be positioned close to the upstream edge region 21A, suitably spaced about 10–150 mm, but more preferably at a maximum of 100 mm, from the edge region 21A.

The device according to FIG. I functions in the following manner. When the machine is started up for operation, the inner surface of the belt is provided with an oil film in order to lubricate between the belt 6 and the pressing surface 21 of the shoe element 2 but also in order to cool the shoe press unit. Oil supply usually takes place in a number of different positions, including through the distribution chamber 7, which lubricates in the central zone of the pressing surface 21 and also usually at least somewhere else directly on the inner surface of the belt. The shoe element 2 exerts, through the force exerted by the pressing unit 3, 5, a pressure against a counter roll (not shown) so that a fibrous web disposed between the counter roll and the belt 6 is subjected to the desired treatment, for example, dewatering. In this connection, the excess oil that accompanies the belt 6 to the upstream end of the shoe element will be pressed out of the converging zone formed between the inner surface 6A of the belt and the upstream edge region 21A of the shoe element. The excess oil O is in this way given an initial kinetic energy and will squirt backwards, counter to the direction of movement of the belt, into the inlet opening 41 to be collected inside the container portion 43A, 43B, 44, 45, 46. By virtue of a slight overpressure inside the shoe press unit (when a closed shoe press unit is used), the oil collected in the container will be pressed out through the first part 48A of the evacuation duct, on through the rubber bellows 48C and then, via the connection pipe 48B, into the outlet pipe 49, to arrive finally in a collecting vessel (not shown). In certain applications, the outlet pipe 49 is connected to a source of vacuum (not shown) in order to ensure adequate oil evacuation. It is usual to try to operate a closed shoe press unit with an inner overpressure of less than 50 mbar.

A certain quantity of oil will not be forcibly expelled in a jet, but will instead follow the surface in the edge region 21A of the shoe element down towards the end wall 23 of the shoe element. By virtue of the guide plate 42, however, which bears against the end wall 23 of the shoe element this quantity of oil will also be guided towards the inlet opening 41. In the embodiment shown in FIG. 1, gravity assists in this connection in bringing about this extra oil inflow to the container. It should be pointed out, however, that this is not a necessity because a certain underpressure can be brought about in the region adjacent to the inlet opening 41 so that this inflow of excess oil can take place even without the influence of gravity. The fact that the evacuation arrangement is arranged with the evacuation pipe vertical does not therefore constitute a limitation of the invention shown.

Figure 3:
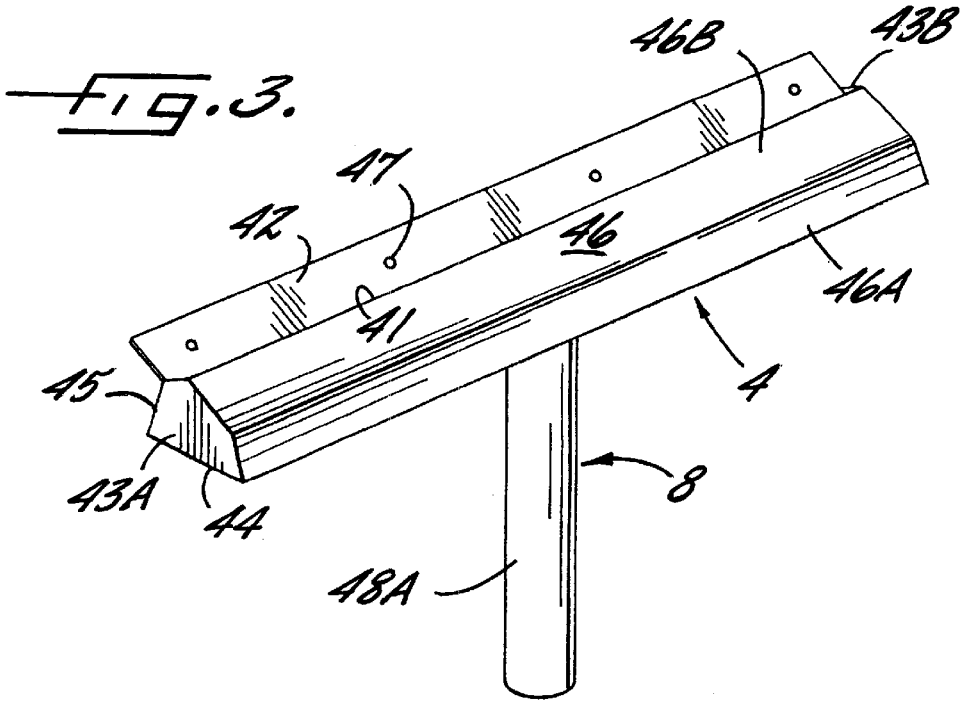
FIG. 3 is a perspective view of an oil evacuation component in accordance with a preferred embodiment of the invention.

FIG. 3 shows in perspective the aforementioned container 43A, 43B, 44, 45, 46 in the form of a unit with a guide plate 42 and an evacuation pipe 48A. It can also be seen that the guide plate 42 is provided with a number of holes 47 for arranging fixing screws 50. By virtue of the fact that the evacuation arrangement in the preferred case is sectioned, in such a manner that a number of containers of limited length are arranged next to one another on the shoe element 2, the inlet opening 41, which preferably extends along the entire width of the container, of each container will always be optimally positioned in relation to the squirting oil irrespective of deflection of the beam 1. According to the preferred embodiment, the length of each container is approximately 1 meter. The length of a container should suitably not be less than 500 mm or more than 1500 mm, so that optimum evacuation can be achieved. For the same reason, the diameter of the evacuation duct/pipe should not be too small; suitably it is approximately 60 mm. The diameter should preferably not be less than 10 mm and should suitably not exceed 50 mm.

Figure 4:
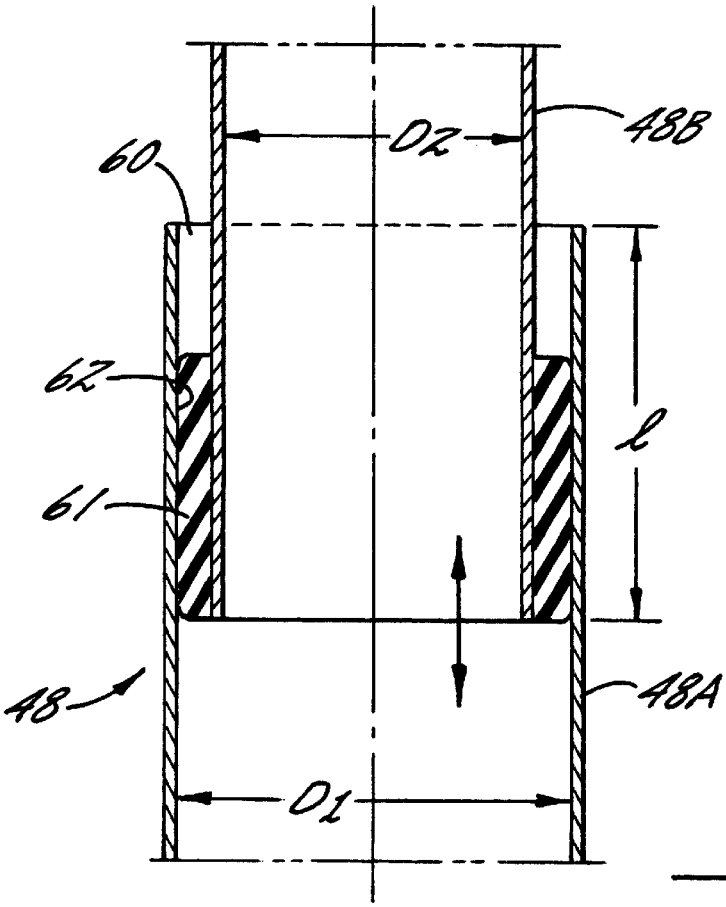
FIG. 4 is a cross-sectional view of an alternative embodiment of an evacuation duct arrangement in accordance with the invention.

FIG. 4 shows a first alternative embodiment according to the invention, the evacuation duct 48 being provided with two telescopically arranged parts 48A, 48B. The first part 48A of the evacuation duct is in this connection provided with a relatively large diameter D1, while the second part 48B of the evacuation duct is provided with a considerably smaller diameter D2. The two duct parts are arranged so that, in the rest position, they overlap over a considerable length l which is preferably at least the same as the diameter of the first duct part 48A. Arranged in the annular gap 60 formed between the overlapping pipe parts is a seal 61 which, according to the preferred embodiment, is fixed to the end of the second duct part 48B. Movement is therefore possible between the seal 61 and the first duct part 48A, a sliding movement taking place in the cylindrical contact region 62 between the seal 61 and the inner surface of the first duct part 48A.

According to another alternative embodiment according to the invention, the evacuation pipe 48A which is fixed to the container is sufficiently long to be capable of entering the outlet pipe 49 through its opening 49A. In this case, a seal, for example one or more O-rings, is arranged directly in the opening 49A on the outlet pipe 49, these seals interacting directly with the outer surface of the evacuation pipe 48A. By virtue of the fact that the outlet pipe 49 can be made with a large diameter, suitably between 100–200 mm, the end of the evacuation pipe 48A can move freely inside the outlet pipe 49 because the maximum stroke length of a shoe element 2 does not normally ever exceed au 50 mm, usually lying between 20–35 mm.

In many applications, it is advantageous if the sealing connection between the first duct part 48A and the adjacent part of the oil evacuation arrangement is flexible in more than one direction so that the connection is flexible in the lateral direction also, because the shoe element can during operation be caused (by lateral forces and/or heat) to make certain lateral movements, which movements the first duct part 48A has to be capable of following without the risk of complications.

Many modifications and other embodiments of the invention will come to mind to one skilled in the art to which this invention pertains having the benefit of the teachings presented in the foregoing descriptions and the associated drawings. For example, the evacuation arrangement can be made of many other materials than thin sheet metal, for example a polymer material. It is also clear that the inlet opening 41 of the evacuation arrangement can be divided (for example, for reasons of strength) so that a number of elongate openings next to one another is formed. It is also clear that the component parts of the evacuation arrangement do not necessarily have to made of/from one and the same material, but can be made from a number of different components/materials, which can be arranged with/connected to one another in many alternative ways that will be self-evident to the person skilled in the art. It is also clear that it is only for the purpose of exemplification that the evacuation arrangement is shown as being attached to a distribution block. The evacuation arrangement can of course be affixed directly on the shoe element 2, for example, along its side wall 23. In some cases, the evacuation arrangement can be firmly anchored to the pressing unit of the shoe element, which unit is movable together with the shoe element. It is also clear that devices other than a rubber bellows 48C can be provided for making the flexible, sealing connection between the two pipe members in the evacuation arrangement, for example a fiber-reinforced flexible and impermeable polymer material other than rubber, or a liquid-tight fabric material. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for operating a shoe press unit having a beam, a shoe element movably supported on the beam and having a pressing surface, a flexible belt arranged to slide over the pressing surface of the shoe element, and a pressing unit operable to urge the shoe element in a pressing direction away from the beam, the method comprising:

supplying oil between the belt and the pressing surface of the shoe element for lubricating therebetween, excess oil being expelled under pressure from between the belt and the shoe element at an upstream edge region of the shoe element such that the excess oil exits from between the belt and shoe element with an initial kinetic energy;

capturing the excess oil expelled from between the belt and the shoe element with an oil evacuation arrangement formed separately from the shoe element and affixed to the shoe element such that the shoe element and oil evacuation arrangement move together as a unit, the oil evacuation arrangement including an evacuation duct fixed relative to the shoe element for evacuating excess oil expelled from between the belt and shoe element; and passing the oil evacuated through the duct into an outlet pipe fixed relative to the beam, and providing a movable coupling between the duct and the outlet pipe such that the duct can move in at least the pressing direction relative to the outlet pipe as the shoe element is moved back and forth by the pressing unit.

2. The method of claim 1, wherein the evacuation duct includes a first tubular member that is substantially rigid and extends through a through-hole formed in the beam so as to be movable within the through-hole.

3. The method of claim 2, wherein the oil evacuated through the evacuation duct is passed through the first tubular member of the duct into the outlet pipe arranged in an interior of the beam.

4. The method of claim 1, wherein the evacuation duct includes a first tubular member that is substantially rigid and is firmly affixed to the shoe element, and wherein the oil evacuated through the first tubular member is passed to the outlet pipe via a flexible sealing member arranged between the first tubular member and the outlet pipe.

5. The method of claim 1, further comprising pressurizing an interior of the shoe press unit with an overpressure of about 10–500 mbar.

6. The method of claim 1, further comprising exerting a vacuum on the outlet pipe for facilitating evacuating the excess oil from the shoe press unit.

7. A shoe press unit, comprising:

a beam;

a shoe element movably supported on the beam and having a pressing surface and an upstream edge region;

a pressing unit for urging the shoe element in a pressing direction away from the beam;

a flexible belt arranged to slide over the pressing surface of the shoe element, oil being supplied between the belt and the pressing surface for lubricating the belt, an excess oil being expelled under pressure from between the belt and the shoe element at the upstream edge region of the shoe element such that the excess oil exits from between the belt and shoe element with an initial kinetic energy;

an oil evacuation arrangement formed separately from the shoe element and affixed to the shoe element proximate the upstream edge region thereof such that the shoe element and oil evacuation arrangement move together as a unit, the oil evacuation arrangement including an evacuation duct fixed relative to the shoe element for evacuating excess oil expelled from between the belt and shoe element; and an outlet pipe fixed relative to the beam, the duct being movably connected to the outlet pipe such that the duct can move in at least the pressing direction relative to the outlet pipe as the shoe element is moved back and forth by the pressing unit.

8. The shoe press unit of claim 7, wherein the evacuation duct includes a first tubular member that is substantially rigid and extends through a through-hole formed in the beam so as to be movable within the through-hole.

9. The shoe press unit of claim 7, wherein the evacuation arrangement includes a container having an inlet opening through which the excess oil is received, and the evacuation duct includes a first tubular member that is substantially rigid and is fixed to the container for evacuating oil therefrom.

10. The shoe press unit of claim 9, wherein the first tubular member is connected to the outlet pipe via a flexible sealing member.

11. The shoe press unit of claim 10, wherein the sealing member comprises a flexible tubular device having one end sealingly connected to an end of the first tubular member and an opposite end sealingly connected to an attachment that is fixedly attached to the outlet pipe.

12. The shoe press unit of claim 11, wherein the flexible tubular device comprises an elastomeric bellows.

13. The shoe press unit of claim 11, wherein the attachment comprises a pipe connected to the outlet pipe in a sealing manner.

14. The shoe press unit of claim 7, wherein the duct is connected to the outlet pipe via a sealing device comprising two tubular members one of which is slidably received inside the other.

15. The shoe press unit of claim 7, wherein the oil evacuation duct includes a substantially rigid tubular member that is slidably and sealingly received through an opening in a wall of the outlet pipe.

16. The shoe press unit of claim 15, wherein at least one seal is arranged at the opening in the outlet pipe for sealing against an outer surface of the tubular member of the evacuation duct.

17. The shoe press unit of claim 15, wherein the tubular member of the evacuation duct has a diameter of about 30–100 mm.

18. The shoe press unit of claim 7, wherein the evacuation arrangement comprises at least two containers arranged end-to-end and extending lengthwise along the shoe element in a cross-machine direction, each container having an inlet opening arranged for receiving excess oil expelled from between the belt and pressing surface, and each container having an evacuation duct movably connected to the outlet pipe.

* * * * *

UNITED STATES PATENT AND TRADEMARK OFFICE

CERTIFICATE OF CORRECTION

PATENT NO. : 6,402,890 B1
DATED : June 11, 2002
INVENTOR(S) : Gustavsson et al.

It is certified that error appears in the above-identified patent and that said Letters Patent is hereby corrected as shown below:

Title page,
Item [*] Notice, insert the following:
-- Notice: This patent is subject to a terminal disclaimer. --
Item [30], insert the following:
-- [30] Foreign Application Priority Data
Dec. 8, 1999 (SE) 9904493-5 --.

Signed and Sealed this

Fifteenth Day of October, 2002

*Attest:*

*Attesting Officer*

JAMES E. ROGAN
*Director of the United States Patent and Trademark Office*